US010781066B2

(12) United States Patent
Kishimoto et al.

(10) Patent No.: US 10,781,066 B2
(45) Date of Patent: Sep. 22, 2020

(54) SHEET POSTPROCESSING DEVICE AND IMAGE FORMING SYSTEM THEREWITH

(71) Applicant: KYOCERA Document Solutions Inc., Osaka (JP)

(72) Inventors: Tadahisa Kishimoto, Osaka (JP); Terumitsu Noso, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/417,209

(22) Filed: May 20, 2019

(65) Prior Publication Data

US 2019/0367312 A1 Dec. 5, 2019

(30) Foreign Application Priority Data

May 29, 2018 (JP) ..... 2018-102700

(51) Int. Cl.

| | |
|---|---|
| ***B65H 37/04*** | (2006.01) |
| ***B65H 29/24*** | (2006.01) |
| ***B65H 37/06*** | (2006.01) |
| ***B65H 31/34*** | (2006.01) |

(52) U.S. Cl.

CPC ..... *B65H 29/247* (2013.01); *B65H 29/245* (2013.01); *B65H 29/246* (2013.01); *B65H 31/34* (2013.01); *B65H 37/04* (2013.01); *B65H 37/06* (2013.01); *B65H 2515/212* (2013.01)

(58) Field of Classification Search

CPC .. B65H 29/245; B65H 29/246; B65H 29/247; B65H 31/34; B65H 37/04; B65H 37/06; B65H 2515/212

USPC ..... 270/32, 37, 58.07, 58.08, 58.12

See application file for complete search history.

(56) References Cited

U.S. PATENT DOCUMENTS

| | | | | |
|---|---|---|---|---|
| 5,013,021 A * | 5/1991 | Johdai | B65H 1/12 | 270/58.12 |
| 5,460,361 A * | 10/1995 | Mokler | B65H 29/246 | 271/183 |
| 6,522,841 B2 * | 2/2003 | Horikoshi | B65H 29/14 | 271/211 |
| 6,889,971 B2 * | 5/2005 | Tamura | B42B 2/00 | 270/58.08 |
| 8,395,828 B2 * | 3/2013 | Miyazaki | B65H 29/42 | 270/58.07 |

(Continued)

FOREIGN PATENT DOCUMENTS

JP 2007-137663 A 6/2007

*Primary Examiner* — Leslie A Nicholoson, III
(74) *Attorney, Agent, or Firm* — Stein IP, LLC

(57) ABSTRACT

A sheet postprocessing device includes a sheet conveying passage, a sheet tray, an inlet guide, a processing device, and a blowing device. Though the sheet conveying passage, a sheet on which an image has been formed is conveyed. The sheet tray is arranged downstream of the sheet conveying passage and has sheets stacked on it. The inlet guide is arranged at the downstream end of the sheet conveying passage and guides a sheet to the sheet tray. The processing device performs predetermined processing on a sheet stacked on the sheet tray. The blowing device blows air, from the upstream side in the sheet conveying direction, between the top face of the top-most sheet in the sheets stacked on the sheet tray and the bottom face of the subsequent sheet sent from the inlet guide into the sheet tray.

12 Claims, 8 Drawing Sheets

(56) References Cited

U.S. PATENT DOCUMENTS

| | | | | |
|---|---|---|---|---|
| 8,727,345 | B2 * | 5/2014 | Konno | B65H 29/00 271/195 |
| 8,915,492 | B2 * | 12/2014 | Sugiyama | B65H 31/26 270/58.12 |
| 8,925,917 | B2 * | 1/2015 | Watanabe | B65H 29/00 271/211 |
| 8,936,240 | B2 * | 1/2015 | Hoshino | G03G 15/6552 271/211 |
| 9,075,377 | B2 * | 7/2015 | Nagasako | G03G 15/6552 |
| 9,260,264 | B2 * | 2/2016 | Hoshino | B65H 31/10 |
| 10,183,829 | B2 * | 1/2019 | Tokuma | B65H 29/14 |
| 10,226,946 | B2 * | 3/2019 | Kodama | B65H 29/70 |

* cited by examiner

SHEET POSTPROCESSING DEVICE AND IMAGE FORMING SYSTEM THEREWITH

INCORPORATION BY REFERENCE

This application is based upon and claims the benefit of priority from the corresponding Japanese Patent Application No. 2018-102700 filed on May 29, 2018, the contents of which are hereby incorporated by reference.

BACKGROUND

The present disclosure relates to a sheet postprocessing device for performing postprocessing such as binding and folding process on a sheet on which an image has been formed by image forming apparatuses such as copiers and printers, and also relates to image forming systems provided with such a sheet postprocessing device.

Conventionally, sheet postprocessing devices are used which can perform postprocessing including binding process in which a plurality of sheets on which images have been formed by an image forming apparatus such as a copier or printer are stacked and the stacked bundle of sheets is bound with staples, as well as folding process in which twofold or threefold folding is performed on a bundle of sheets.

In such sheet postprocessing devices, sheets on which images have been formed are conveyed in a sheet conveying passage and stacked on a sheet tray. When a predetermined number of sheets are stacked on the sheet tray, binding or folding process is applied on a bundle of sheet on the sheet tray.

For example, there are known sheet postprocessing devices in which a predetermined number of sheets are stacked on the sheet tray and binding and folding process is applied on a bundle of sheets on the sheet tray.

Inconveniently, however, in the conventional sheet postprocessing devices mentioned above, when a sheet is stacked on a sheet tray from a sheet conveying passage, the conveyed sheet may make close contact with the stacked sheets to cause a jam (sheet jam).

SUMMARY

According to one aspect of the present disclosure, a sheet postprocessing device includes a sheet conveying passage, a sheet tray, an inlet guide, a processing device, and a blowing device. Though the sheet conveying passage, a sheet on which an image has been formed is conveyed. The sheet tray is arranged downstream of the sheet conveying passage and has sheets stacked on it. The inlet guide is arranged at the downstream end of the sheet conveying passage and guides a sheet to the sheet tray. The processing device performs predetermined processing on a sheet stacked on the sheet tray. The blowing device blows air, from the upstream side in the sheet conveying direction, between the top face of the top-most sheet in the sheets stacked on the sheet tray and the bottom face of the subsequent sheet sent from the inlet guide into the sheet tray.

This and other objects of the present disclosure, and the specific benefits obtained according to the present disclosure, will become apparent from the description of embodiments which follows.

DETAILED DESCRIPTION

Hereinafter, with reference to the accompanying drawings, embodiments of the present disclosure will be described.

With reference to FIGS. 1 to 11, an image forming system composed of a sheet postprocessing device 30 according to one embodiment of the present disclosure and an image forming apparatus 10 with which the sheet postprocessing device 30 is coupled will be described. Although this embodiment deals with a multifunction peripheral as one example of the image forming apparatus 10, the sheet postprocessing device 30 of the present disclosure can also be similarly coupled with any image forming apparatuses other than the digital multifunction peripheral, such as a laser printer, an ink-jet printer, and a facsimile machine.

Figure 1:
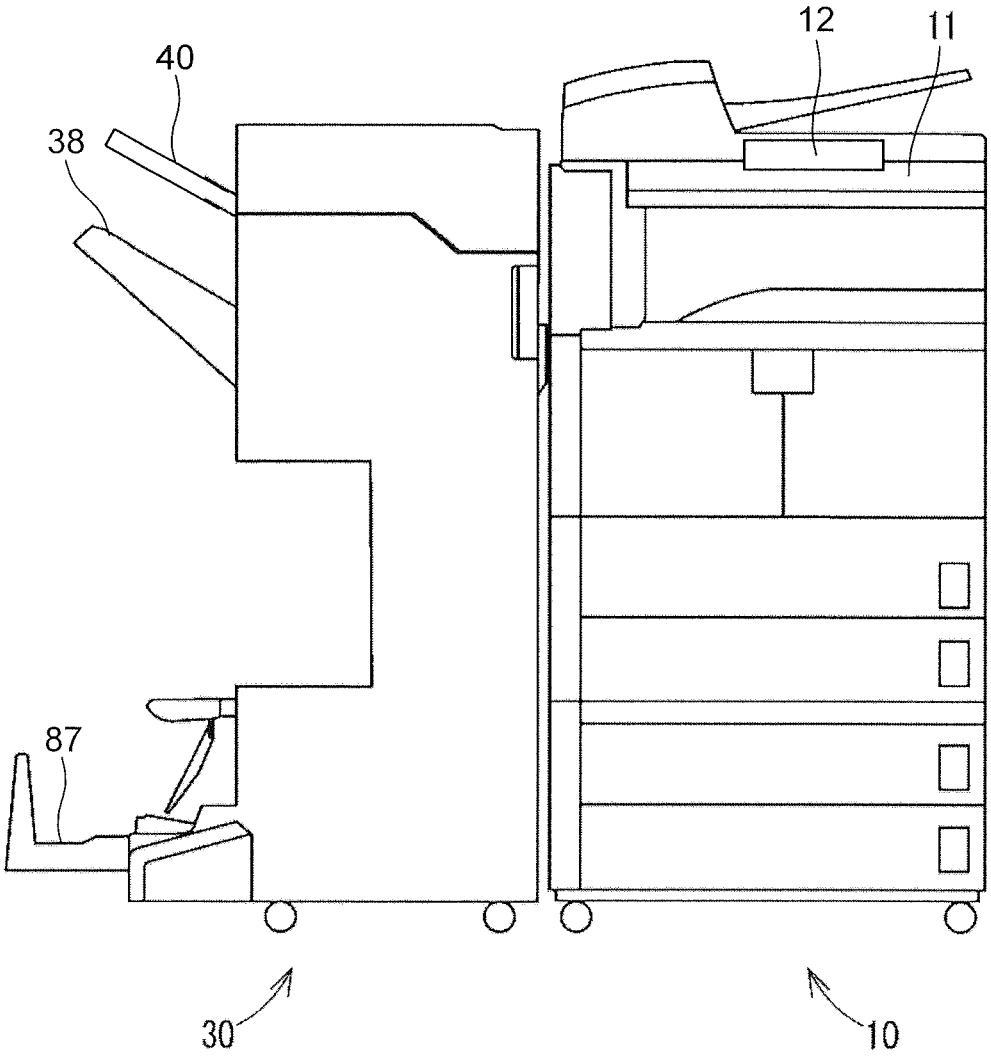
FIG. 1 is a schematic diagram showing the structure of an image forming system composed of a sheet postprocessing device according to an embodiment of the present disclosure and an image forming apparatus with which the sheet postprocessing device is coupled.
Figure 2:
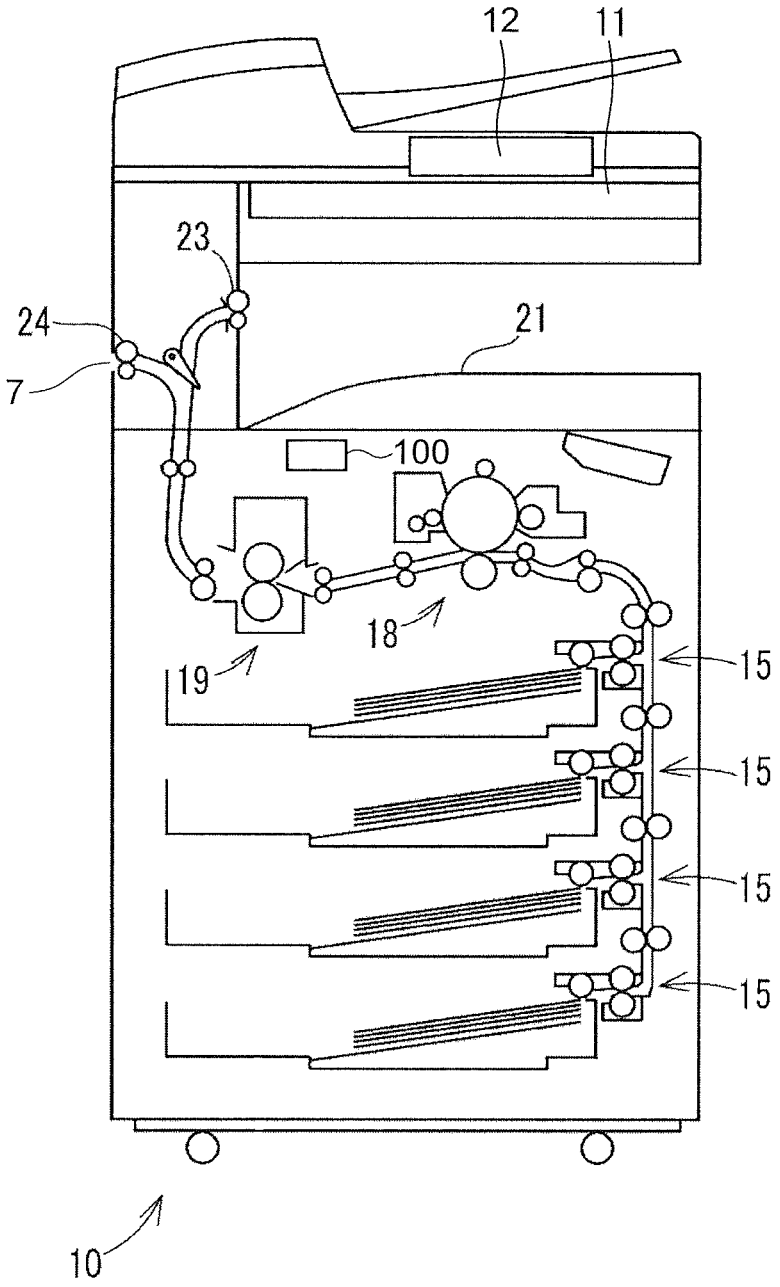
FIG. 2 is a sectional view showing the structure of the image forming apparatus with which the sheet postprocessing device according to the embodiment of the present disclosure is coupled.

As shown in FIG. 1, the image forming apparatus 10 is used in a form coupled with the sheet postprocessing device 30. Based on image data input from outside via an unillustrated network communication portion or based on image data read by an image reading portion 11 arranged in an upper part of the image forming apparatus 10, the image forming apparatus 10 prints an image on a sheet. As shown in FIG. 2, the image forming apparatus 10 includes a sheet feeding portion 15, an image forming portion 18, a fixing portion 19, discharge roller pairs 23 and 24, and a main body controller 100. The sheet feeding portion 15 feeds sheets. The image forming portion 18 forms a toner image on a sheet. The fixing portion 19 fixes a toner image on a sheet. The discharge roller pairs 23 and 24 convey a fixed sheet and discharge it to a sheet discharge portion 21 and a sheet postprocessing device 30 respectively. The main body controller 100 controls the operation of the image forming apparatus 10, and is configured to be communicable with a postprocessing controller 101, which will be described later, of the sheet postprocessing device 30 so that the main body controller 100 also controls the postprocessing controller 101.

The sheet postprocessing device 30 performs on the sheets conveyed from the image forming apparatus 10 postprocessing such as punch hole-forming, binding, and folding. The sheet postprocessing device 30 is not limited to one which performs postprocessing on the sheets conveyed automatically from the image forming apparatus 10. Instead, it may be one which conveys on its own a sheet set on an unillustrated tray by a user to a position where postprocessing is possible to perform postprocessing on the sheet.

Figure 3:
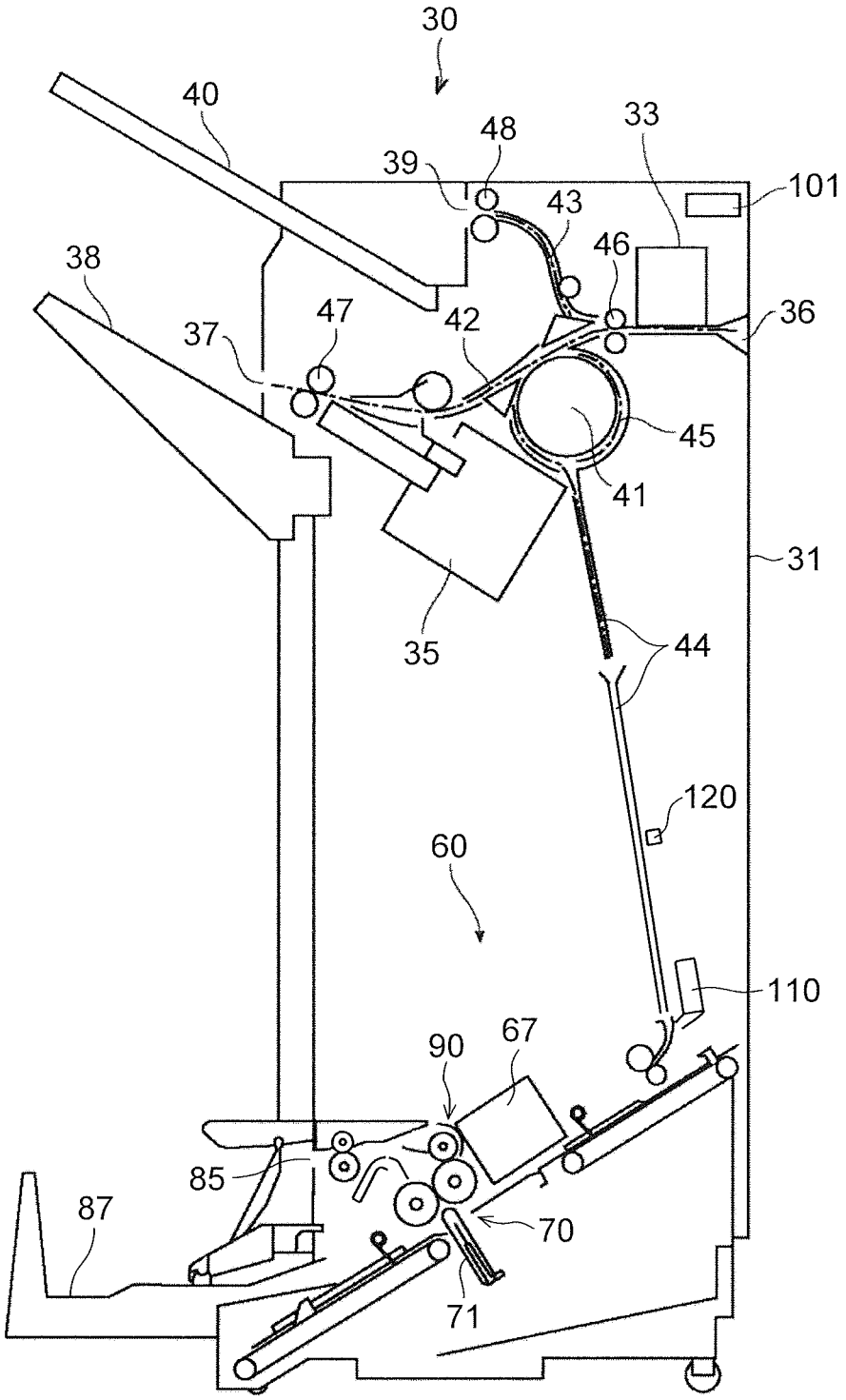
FIG. 3 is a sectional view showing the structure of the sheet postprocessing device according to the embodiment of the present disclosure.

As shown in FIG. 3, the sheet postprocessing device 30 includes a punch hole forming device 33, a stapling unit 35, and a sheet folding unit 60. The punch hole forming device 33 applies predetermined punching process on a sheet. The stapling unit 35 binds a plurality of stacked sheets with a staple. The sheet folding unit 60 applies folding process on a sheet. The punch hole forming device 33 and the stapling unit 35 are provided in a postprocessing device main body 31, and the sheet folding unit 60 is removably fitted to the postprocessing device main body 31.

The sheet postprocessing device 30 includes a sheet feeding port 36, a main discharge tray 38, a sub discharge tray 40, a retraction drum 41, a postprocessing controller 101, various switching members, various rollers, and the like. Through the sheet feeding port 36, the sheets discharged from a discharge portion 7 (see FIG. 2) of the image forming apparatus 10 are conveyed in. The main discharge tray 38 receives the sheets discharged from a main discharge port 37. The sub discharge tray 40 receives the sheets discharged from a sub discharge port 39. The retraction drum 41 temporarily retracts the sheets in a predetermined conveying passage. The postprocessing controller 101 controls the sheet postprocessing device 30 comprehensively. The postprocessing controller 101 is one example of "a controller" according to the present disclosure.

The sheet feeding port 36 communicates with the main discharge port 37 with each other through a first conveying passage 42. A second conveying passage 43 which is connected to the first conveying passage 42 to branch off from it is connected to the sub discharge port 39. A third conveying passage 44 which is connected to the first conveying passage 42 to branch off from it is connected to the sheet folding unit 60. A fourth conveying passage 45 connected to the third conveying passage 44 to branch off from it curves along the circumference of the retraction drum 41 and joins the first conveying passage 42. The third conveying passage 44 is one example of "a sheet conveying passage" according to the present disclosure.

Sheets conveyed in through the sheet feeding port 36 are sent on to the downstream side by the registration roller pair 46. At the downstream end of the first conveying passage 42, a main discharge roller pair 47 for sending sheets out to the main discharge tray 38 is provided. The main discharge roller pair 47 is configured such that, when sending sheets on to the stapling unit 35, the rollers separate from each other to release the nip. The main discharge tray 38 mainly receives a bundle of sheets which has been bound in the stapling unit 35. It is also possible to receive sheets which are not post-processed or only punched on the main discharge tray 38.

At the downstream end of the second conveying passage 43, a sub discharge roller pair 48 for sending sheets out to the sub discharge tray 40 is provided. The sub discharge tray 40 mainly receives sheets which are discharged without being post-processed or which have only been punched at the postprocessing device 30.

The punch hole forming device 33 is arranged between the sheet feeding port 36 and the registration roller pair 46 so as to face the first conveying passage 42 from above. The punch hole forming device 33 applies punching process on a sheet conveyed through the first conveying passage 42 with predetermined timing.

The stapling unit 35 is arranged on the downstream side of the first conveying passage 42 to face it from below. The stapling unit 35 applies stacking process by stacking a plurality of sheets to form a bundle of sheets, as wells as applies binding process by binding a bundle of stacked sheets with a staple.

The retraction drum 41, when binding a plurality of bundles of sheets successively, if a previous bundle is being bound, retracts the first sheet of the subsequent bundle on the outer circumferential face of the retraction drum 41 temporarily, and then conveys it to the stapling unit 35 with the second sheet overlapping the first one.

Next, the sheet folding unit 60 in the sheet postprocessing device 30 will be described. In the following description, for convenience, "a sheet S" can be a single sheet S or a bundle of a plurality of sheets S.

Figure 4:
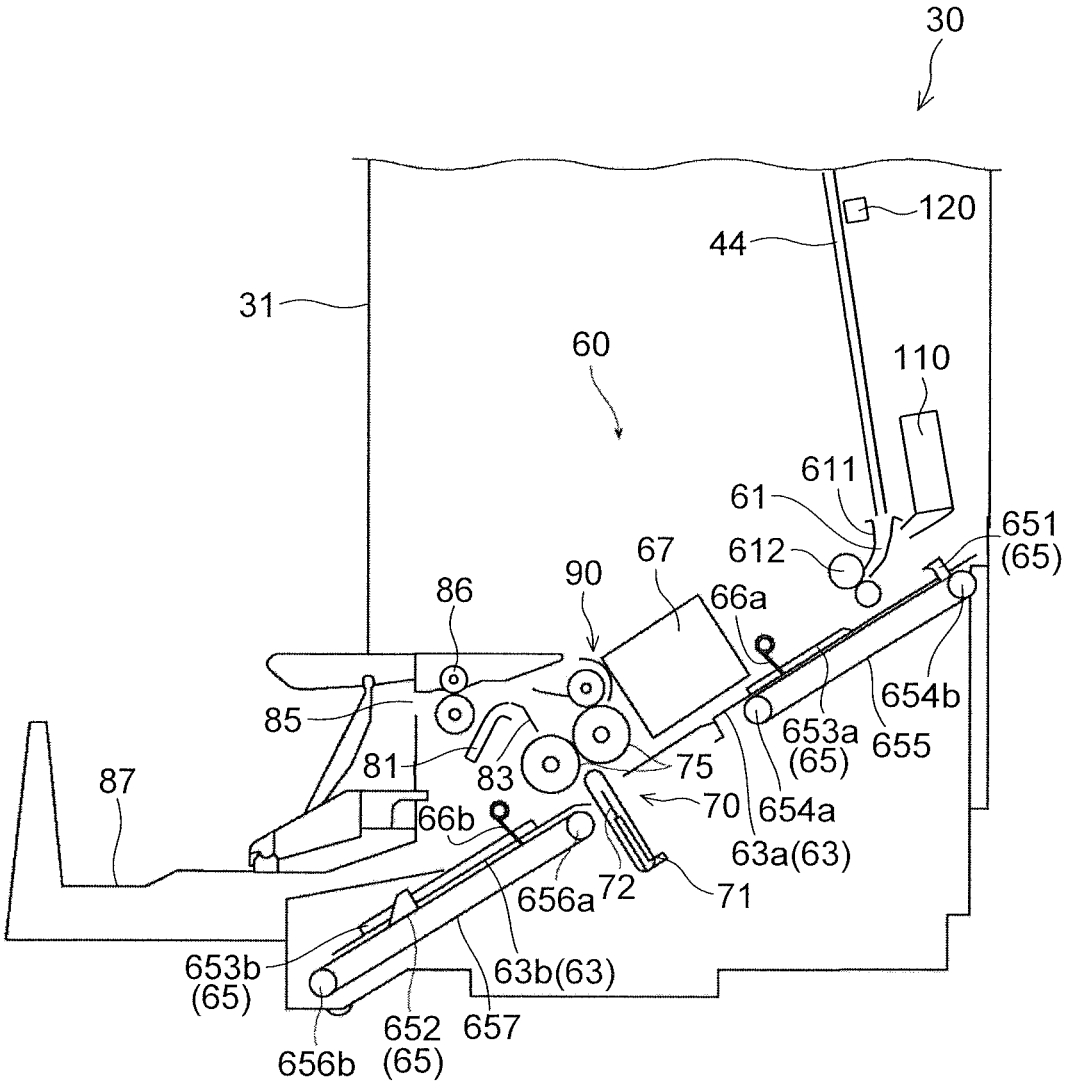
FIG. 4 is a sectional view showing the structure of and around a sheet folding unit of the sheet postprocessing device according to the embodiment of the present disclosure.

As shown in FIG. 4, the sheet folding unit 60 is provided in a lower part of the sheet postprocessing device 30 and on the downstream side of the third conveying passage 44. When a user selects folding process, the sheet folding unit 60 performs, for example, twofold folding or threefold folding process to a sheet S.

The sheet folding unit 60 includes a sheet inlet passage 61, a sheet tray 63, and an aligning member 65. The sheet inlet passage 61 leads to the downstream end of the third conveying passage 44. The sheet tray 63 is composed of an upstream-side sheet stacking portion 63*a* and a downstream-side sheet stacking portion 63*b* on which sheets S conveyed in from the sheet inlet passage 61 are stacked. The aligning member 65 aligns the position of sheets S stacked on the sheet tray 63.

The sheet folding unit 60 is provided with a first folding device (folding device) 70, a sheet entrance path 81, and a second folding device (folding device) 90. The first folding device (folding device) 70 performs first folding process on a sheet S. The sheet S on which first folding process has been applied by the first folding device 70 can enter a sheet entrance path 81. The second folding device (folding device) 90 performs second folding process on the sheet S on which first folding process has been applied by the first folding device 70. The first folding device (folding device) 70, the second folding device (folding device) 90, and a stapling device 67 are examples of "a processing device" according to the present invention. The processing device performs predetermined processing on a sheet S stacked on the sheet tray 63.

The sheet folding unit 60 further includes a conveyance destination switching member 83 and a lower discharge tray (discharge tray) 87. The conveyance destination switching member 83 switches the conveyance destination of the sheet S on which first folding process has been applied by the first folding device 70. The lower discharge tray 87 receives a sheet S discharged from a lower discharge port (sheet discharge port) 85.

The sheet inlet passage 61 is a passage for conveying into the sheet folding unit 60 the sheet S which has been conveyed through the third conveying passage 44. The sheet inlet passage 61 is composed of an inlet guide 611 which guides a sheet S. At a downstream end of the inlet guide 611, an inlet roller pair 612 for sending the sheet S into the sheet folding unit 60 is provided.

The upstream-side sheet stacking portion 63*a* and the downstream-side sheet stacking portion 63*b* are composed of, for example, a plate-like member, and they are provided so as to describe a straight line extending obliquely from upper right to lower left inside the sheet folding unit 60 (that is, so as to incline downward toward the downstream side). Specifically, the upstream-side sheet stacking portion 63*a* is arranged on the upstream side of a push-out mechanism 71, which will be described later, in the sheet conveying direction. On the other hand, the downstream-side sheet stacking portion 63*b* is arranged apart from the upstream-side sheet stacking portion 63*a*, on the downstream side of the push-out mechanism 71 in the sheet conveying direction. Arranged above the upstream-side sheet stacking portion 63*a* is the stapling device 67 which applies binding process on a bundle of sheets which is folded at the first folding device 70.

The aligning member 65 includes an upper moving member 651, a lower moving member 652, and width-adjusting members 653*a* and 653*b*. The upper and lower moving members 651 and 652 align the leading edge and the trailing edge of sheets S stacked on the upstream-side and downstream-side sheet stacking portions 63*a* and 63*b*. The width-adjusting members 653*a* and 653*b* align the side ends of sheets S in the sheet width direction perpendicular to the sheet conveying direction.

The upper moving member 651 is fitted to an upstream-side belt 655 stretched between an upstream-side driving pulley 654*a* and an upstream-side driven pulley 654*b* which are arranged under the upstream-side sheet stacking portion 63*a*. The lower moving member 652 is fitted to a downstream-side belt 657 stretched between a downstream-side driving pulley 656*a* and a downstream-side driven pulley 656*b* which are arranged under the downstream-side sheet stacking portion 63*b*. The lower moving member 652 sustains the leading edge of a sheet S. Moving the upper and lower moving members 651 and 652 according to the size of sheets S (length in the sheet conveying direction) allows the position of the sheets S stacked on the upstream-side and downstream-side sheet stacking portions 63*a* and 63*b* to be aligned in the sheet conveying direction (that is, in the longitudinal direction of sheets S).

A pair of width-adjusting member 653*a* is provided on the upstream-side sheet stacking portion 63*a* at an interval in the sheet width direction (in the direction perpendicular to the plane of FIG. 4). A pair of the width-adjusting member 653*b* is provided on the downstream-side sheet stacking portion 63*b* at an interval in the sheet width direction. A pair of width-adjusting member 653*a* moves, by a rack and pinion mechanism (unillustrated), according to the size of a sheet S (its length in the sheet width direction). A pair of width-adjusting member 653*b* moves, by a rack and pinion mechanism (unillustrated), according to the size of a sheet S (its length in the sheet width direction). This enables the width-adjusting members 653*a* and 653*b* to perform width alignment and skew correction for sheets S.

Alignment by the aligning member 65 is performed every time a sheet S is stacked on the sheet tray 63. When sheets S reach a predetermined number, they are aligned by the aligning member 65, and are then moved to the position for binding process or folding process.

Above the upstream-side and downstream-side sheet stacking portions 63*a* and 63*b*, elastic upstream-side and downstream-side paddles 66*a* and 66*b* are provided respectively. The upstream-side and downstream-side paddles 66*a* and 66*b* rotate in the clockwise direction in FIG. 4, and thereby thrust the leading edge of a sheet S sent out from the sheet inlet passage 61 to the sheet tray 63 onto the lower moving member 652 of the aligning member 65. When a sheet S is moved by the aligning member 65 to the position for binding process or folding process, the upstream-side and downstream-side paddles 66*a* and 66*b* are held at a rotational position retracted from the sheet S.

The first folding device 70 includes a push-out mechanism 71 and a first folding roller pair 75. The push-out mechanism 71 pushes out a sheet S. The first folding roller pair 75 performs folding process on a sheet S pushed out by the push-out mechanism 71.

The push-out mechanism 71 is arranged between the upstream-side and downstream-side sheet stacking portions 63*a* and 63*b*, under the first folding roller pair 75. The push-out mechanism 71 has a folding blade 72 made of sheet metal which makes contact with the bottom face of the sheet S. The push-out mechanism 71 has a motor and a transmission mechanism (neither of them is illustrated) which makes the folding blade 72 move perpendicularly to the bottom face of a sheet S. The folding blade 72 pushes out a sheet S and feeds it to a first nip portion N1, which will be described later, of the first folding roller pair 75.

Figure 5:
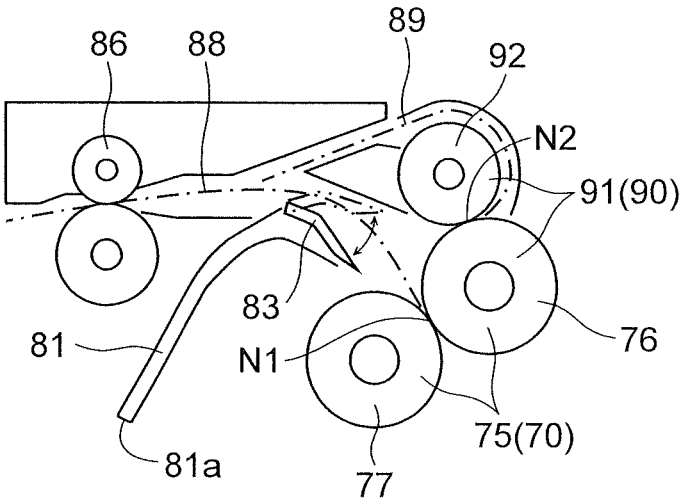
FIG. 5 is a diagram showing the structure of and around a first folding roller pair and a second folding roller pair in the sheet postprocessing device according to the embodiment of the present disclosure.

As shown in FIG. 5, the first folding roller pair 75 is composed of a first roller 76 and a second roller 77 which is located downstream of the first roller 76 in the sheet conveying direction. The first and second rollers 76 and 77 are driven to rotate by a motor via a driving force transmission mechanism (neither of these are illustrated).

Between the first and second rollers 76 and 77, the first nip portion N1 is formed to which a sheet S is fed in by the folding blade 72 of the push-out mechanism 71 (see FIG. 4). When a sheet S passes through the first nip portion N1 while being nipped, a first fold is formed on the sheet S.

On the downstream side of the first nip portion N1 of the first folding roller pair 75, there is provided a first discharge conveying passage 88 which leads to the lower discharge port 85 (see FIG. 4). At the downstream end of the first discharge conveying passage 88, there is provided a discharge roller pair 86. The first discharge conveying passage 88 is a conveying passage for conveying a sheet S on which first folding process has been applied to the lower discharge port 85 without performing second folding process.

The sheet entrance path 81 is connected to the first discharge conveying passage 88 to branch off from it. The conveyance destination switching member 83 is provided at the branch portion between the sheet entrance path 81 and the first discharge conveying passage 88, and by pivoting, it switches the conveyance destination of a sheet S on which first folding process has been applied between the first discharge conveying passage 88 and the sheet entrance path 81.

The sheet entrance path 81 is provided so that a sheet S on which first folding process has been applied by the first folding device 70 can enter it to retract while being bent. The sheet entrance path 81 is arranged opposite the first roller 76 across the conveyance destination switching member 83. The sheet entrance path 81 is curved in the direction along the circumferential face of the second roller 77.

The sheet entrance path 81 is formed so as to correspond to the thickness of the maximum number of sheets S allowing folding process by the sheet folding unit 60. For example, when folding process can handle one to five sheets, the sheet entrance path 81 is structured to have a space big enough to allow entry of sheets S with the thickness of five folded sheets S (the thickness after first folding process, that is, the thickness corresponding to ten sheets).

At the downstream end of the sheet entrance path 81, a stopper 81*a* is provided. The first fold of a sheet S which has entered (retracted to) the sheet entrance path 81 strikes the stopper 81*a*.

The second folding device 90 performs second folding process on a sheet S on which first folding process has been applied and which has struck the stopper 81*a*.

Specifically, the second folding device 90 has a second folding roller pair 91. The second folding roller pair 91 performs second folding process on a sheet S on which first folding process has been applied. The second folding roller pair 91 is composed of the first roller 76 mentioned above and a third roller 92 located above the first roller 76. The first roller 76 is a common roller shared between the first and second folding roller pairs 75 and 91. The third roller 92 is, via a driving force transmission mechanism, driven to rotate by a motor (neither of these are illustrated).

Figure 6:
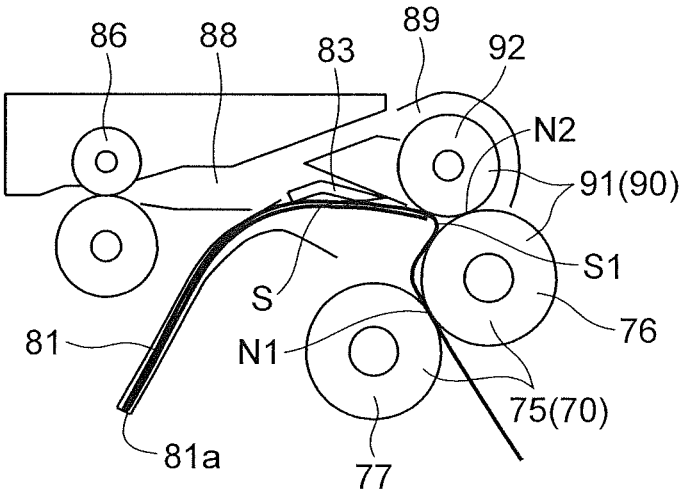
FIG. 6 is a diagram showing the structure of and around the first folding roller pair and the second folding roller pair in the sheet postprocessing device according to the embodiment of the present disclosure, illustrating a state where a bend is formed in a sheet on which first folding process has been applied.
Figure 7:
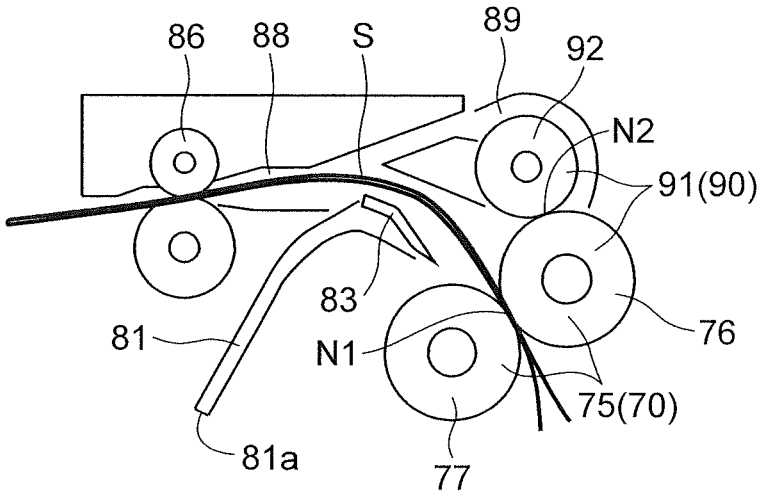
FIG. 7 is a diagram showing the structure of and around the first folding roller pair and the second folding roller pair in the sheet postprocessing device according to the embodiment of the present disclosure, illustrating a state where a sheet on which first folding process has been applied is being discharged from a lower discharge port.

Between the first and third rollers 76 and 92, there is formed a second nip portion N2. As shown in FIG. 6, with the leading edge of a sheet S on which first folding process has been applied in contact with the stopper 81*a*, sheet conveyance by the first folding roller pair 75 is continued. This causes a bend S1 to be formed in the sheet S, and the bend S1 passes while being nipped by the second nip portion N2 of the second folding roller pair 91. This causes a second fold to be formed in the sheet S.

As shown in FIG. 5, on the downstream side of the second nip portion N2 of the second folding roller pair 91, a second discharge conveying passage 89 which joins the first discharge conveying passage 88 is provided. The second discharge conveying passage 89 is a conveying passage for conveying a sheet S on which second folding process has been applied to the lower discharge port 85 via the first discharge conveying passage 88.

Next, with reference to FIGS. 4 to 7, folding process (operation) applied on a sheet S by the sheet folding unit 60 will be described. Folding process on a sheet S is applied by the postprocessing controller 101 (see FIG. 3) included in the sheet postprocessing device 30.

First, twofold folding process will be described. Twofold folding process is applied when a user selects a twofold mode using the operation panel 12 (see FIG. 2) of the image forming apparatus 10. The conveyance destination switching member 83 pivots to a position indicated by solid lines in FIG. 5, and thereby the conveyance destination of a sheet S on which first folding process has been applied by the first folding device 70 is directed to the first discharge conveying passage 88.

A sheet S conveyed in through the sheet inlet passage 61 is stacked on the upstream-side and downstream-side sheet stacking portions 63*a* and 63*b* and is aligned by the aligning member 65. The aligning member 65 arranges the sheet S at a predetermined position so that the folding position of the sheet S faces the tip end of the folding blade 72. Next, the folding blade 72 of the push-out mechanism 71 is thrust out to raise the sheet S upward (in the direction perpendicular to the sheet S). Here, the folding blade 72 makes contact with the folding position of the sheet S. The sheet S raised by the folding blade 72 enters, while being bent, the first nip portion N1 of the first folding roller pair 75. In the sheet S which has passed through the first nip portion N1, the first fold is formed. The sheet S in which the first fold has been formed is, via the first discharge conveying passage 88, discharged from the lower discharge port 85 to the lower discharge tray 87 (see FIG. 7). The push-out mechanism 71 retracts the folding blade 72 to its original standby position. Thereafter, similar folding process is applied repeatedly.

Next, threefold folding process will be described. Threefold folding process is applied when a user selects a threefold mode using the operation panel 12 (see FIG. 2) of the image forming apparatus 10. The process up to first folding process on a sheet S by the first folding device 70 is similar to that in the twofold folding process described above, and thus no overlapping description will be repeated. The conveyance destination switching member 83 pivots to a position indicated by dash-dot-dot-lines in FIG. 5, and thereby the conveyance destination of a sheet S on which first folding process has been applied by the first folding device 70 is directed to the sheet entrance path 81. Thus, a sheet S on which first folding process has been applied is conveyed toward the sheet entrance path 81. The sheet S enters the sheet entrance path 81 and the first fold (folded end) in the sheet S strikes the stopper 81*a* of the sheet entrance path 81.

After the first fold of the sheet S strikes the stopper 81*a*, the first folding roller pair 75 continues to be driven to rotate. Thus, as shown in FIG. 6, the sheet S, while in contact with the inner face of the curved sheet entrance path 81, the conveyance destination switching member 83, and the like, bends so as to bulge toward the second nip portion N2 of the second folding roller pair 91.

The bend S1 formed in the sheet S enters the second nip portion N2 of the second folding roller pair 91. On the sheet S which has passed the second nip portion N2, the second fold is formed. The sheet S on which the second fold has been formed is conveyed through the second discharge conveying passage 89 while winding around the circumferential face of the third roller 92 and is discharged by the discharge roller pair 86 from the lower discharge port 85 to the lower discharge tray 87.

Next, the structure of and around the sheet inlet passage 61 will be described in detail.

Figure 8:
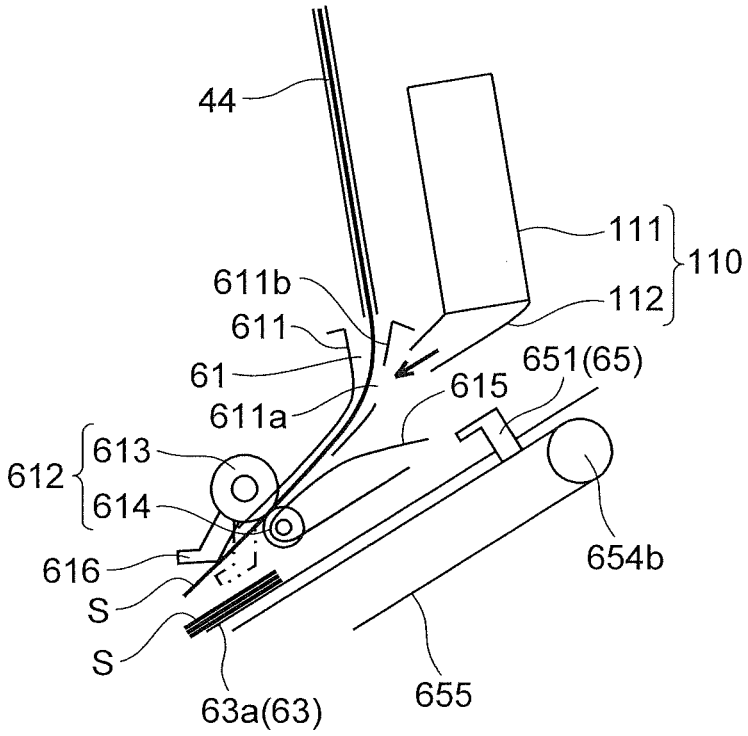
FIG. 8 is a diagram showing the structure of and around an inlet guide of the sheet postprocessing device according to the embodiment of the present disclosure.

As shown in FIG. 8, on the upstream side of the inlet roller pair 612 in the sheet conveying direction, a blowing device 110 is provided. The blowing device 110 blows air between the top face of the top-most sheet S in the sheets S stacked on the sheet tray 63 and the bottom face of the sheet S sent out from the inlet guide 611 to the sheet tray 63.

Specifically, the blowing device 110 has a blowing fan 111 and a duct 112. The blowing fan 111 generates a flow of air. The duct 112 is connected to the blowing fan 111 and discharges air from the blowing fan 111. The duct 112 is provided so as to discharge air parallel to the sheet tray 63.

In a part, facing the duct 112, of a curved guide face 611*b* on the right side of the inlet guide 611 in FIG. 8, an air inflow port 611*a* for taking in air discharged from the duct 112 is formed. A plurality of inflow ports 611*a* are provided at predetermined intervals in the sheet width direction (in the direction perpendicular to the plane of FIG. 8). That is, between the air inflow ports 611*a* themselves, partitions (unillustrated) extending along the sheet conveying direction are provided for preventing a sheet S from going outside through the air inflow port 611*a*.

Below the inlet guide 611, a guide member 615 for guiding a sheet S to the inlet roller pair 612 is provided. The inlet guide 611 and the guide member 615 form the sheet inlet passage 61. The inlet guide 611 and the guide member 615 are curved in such directions that their respective upstream parts in the sheet conveying direction recede from each other. The guide member 615 has also a function of guiding air which has been discharged from the duct 112 and has not flowed into the air inflow port 611*a* to the bottom face of a sheet S.

Figure 9:
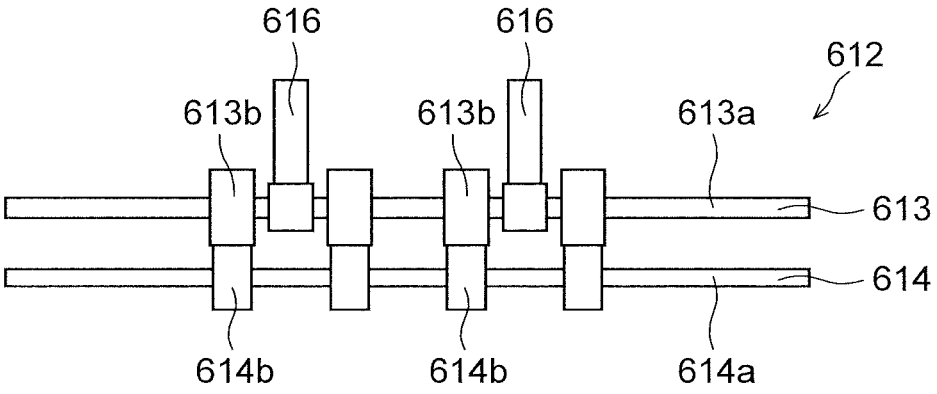
FIG. 9 is a diagram showing the structure of an inlet roller pair in the sheet postprocessing device according to the embodiment of the present disclosure.

The inlet roller pair 612 is composed of a driving roller 613 and a driven roller 614 which is in pressed contact with the driving roller 613. The driving roller 613, as shown in FIG. 9, has a rotary shaft 613*a* and a plurality of roller bodies 613*b* which are arranged at predetermined intervals in the axial direction and are fixed to the rotary shaft 613*a*. The driven roller 614 has a rotary shaft 614*a* and a plurality of roller bodies 614*b* which are arranged at predetermined intervals in the axial direction and are fixed to the rotary shaft 614*a*. Thus, air discharged from the blowing device 110 strikes the bottom face of a sheet S which passes through the inside of the inlet guide 611 in a curved state, then flows along the bottom face of the sheet S, then passes between the bottom face of the sheet S and the rotary shaft 614*a* of the driven roller 614, and then flows between the top face of the top-most sheet S stacked on the sheet tray 63 and the bottom face of the sheet S discharged from the inlet guide 611 to the sheet tray 63.

To the rotary shaft 613*a* of the driving roller 613, a plurality of resin pressing members 616 are fitted which can rotate idly about the rotary shaft 613*a*. When the pressing members 616 make contact with a sheet S being conveyed by the inlet roller pair 612, they pivot to a position indicated by solid lines in FIG. 8. On the other hand, when the trailing edge of a sheet S has passed the inlet roller pair 612, the pressing members 616 pivot, by its own weight, to a position indicated by dash-dot-dot-lines in FIG. 8 and presses the upstream-side end part (trailing edge) of the sheet S against the sheet tray 63.

As shown in FIG. 4, in the third conveying passage 44, a sheet detection sensor 120 for sensing a sheet S is provided.

Figure 10:
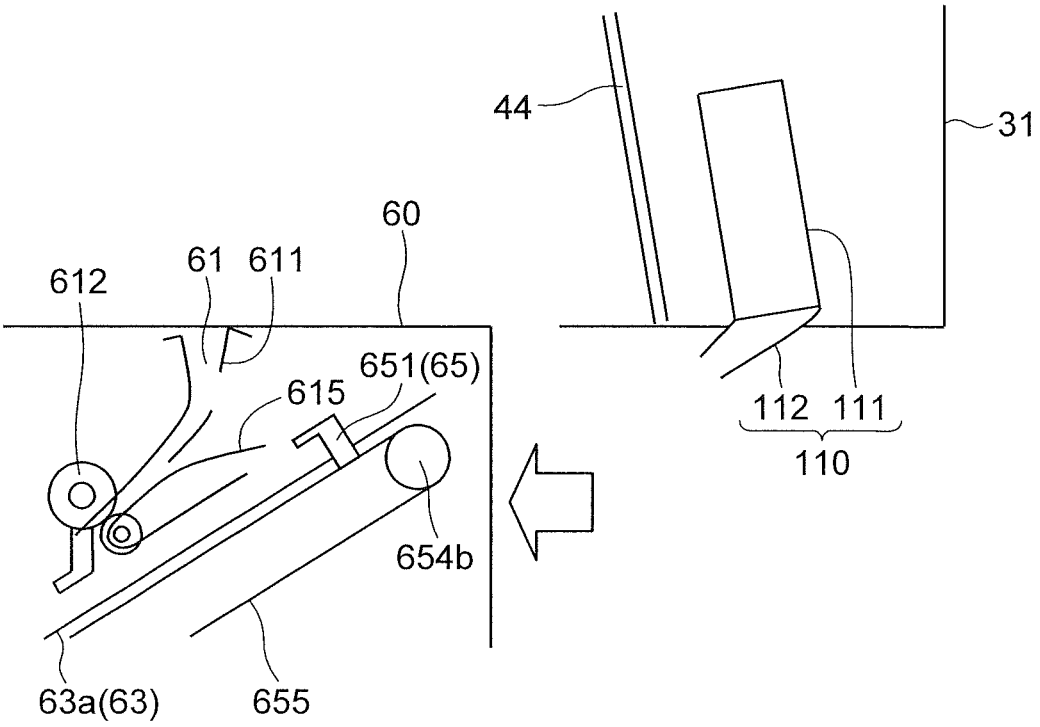
FIG. 10 is a diagram showing a state where the sheet folding unit of the sheet postprocessing device according to the embodiment of the present disclosure is drawn out from the postprocessing device main body.

The third conveying passage 44, the blowing device 110, and the sheet detection sensor 120 are provided in the postprocessing device main body 31. On the other hand, as mentioned above, the inlet guide 611, the sheet tray 63, the stapling device 67, the first folding device 70, the second folding device 90, the lower discharge port 85, and the lower discharge tray 87 are provided in the sheet folding unit 60. Thus, when a sheet jam occurs in the sheet tray 63, the stapling device 67, the first folding device 70, the second folding device 90, or the like, the sheet folding unit 60 can be drawn out, as shown in FIG. 10, with the third conveying passage 44 and the blowing device 110 left behind in the postprocessing device main body 31.

Figure 11:
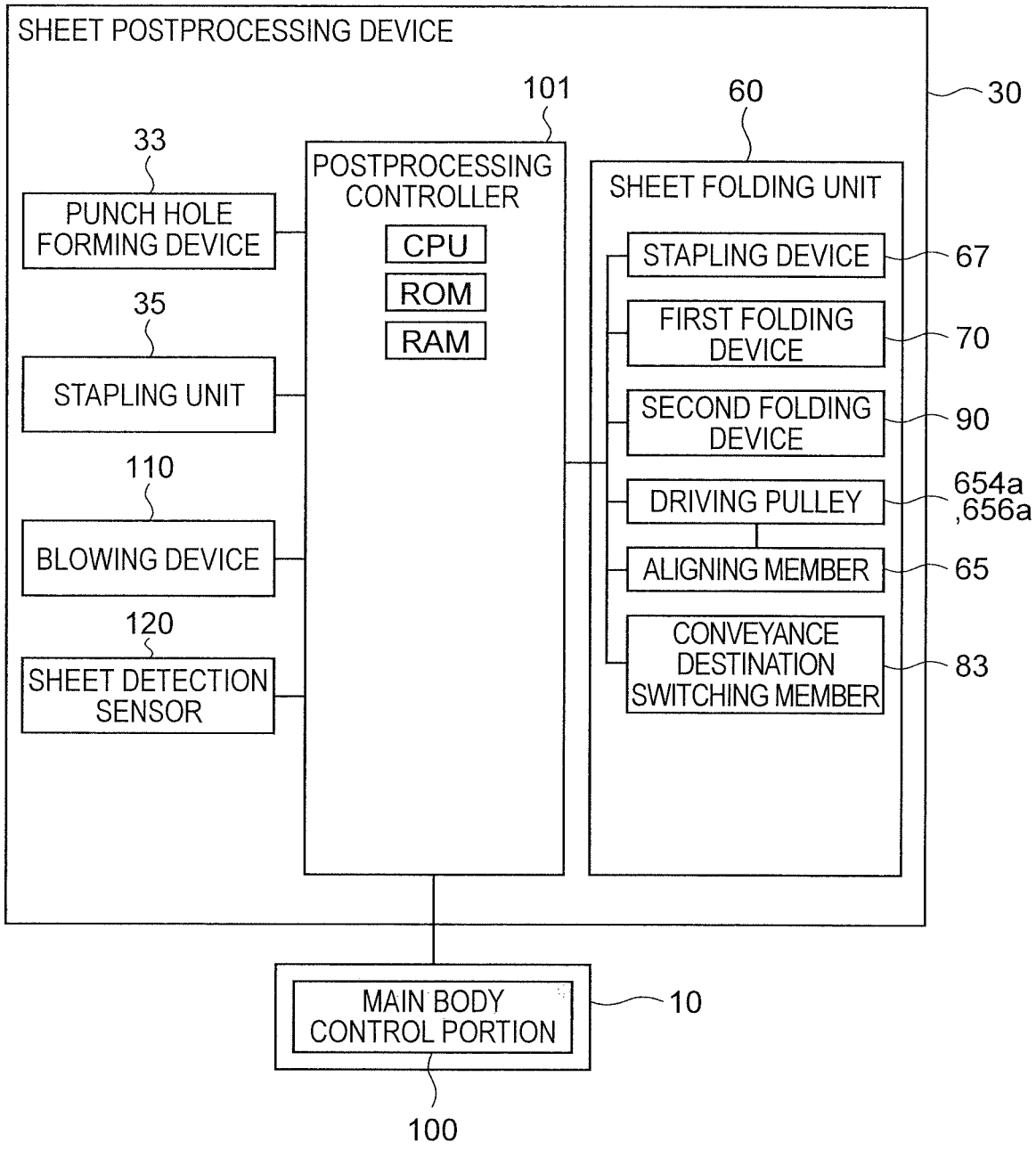
FIG. 11 is a block diagram showing control paths in the sheet postprocessing device according to the embodiment of the present disclosure.

FIG. 11 is a block diagram showing the control paths in the sheet postprocessing device 30. When the sheet postprocessing device 30 is used, different parts of the device are controlled in different manners, and thus the control paths in the whole sheet postprocessing device 30 are complex. Thus, the following description focuses on those control paths which are essential for the implementation of the present disclosure.

As shown in FIG. 11, the postprocessing controller 101 is composed of a CPU (central processing unit), a ROM (read-only memory), a RAM (random access memory), and the like, and is configured to be communicable with the main body controller 100 of the image forming apparatus 10. Also, the postprocessing controller 101 can control the punch hole forming device 33, the stapling unit 35, the blowing device 110, the sheet folding unit 60, various rollers, and the like, and is configured to be communicable with the sheet detection sensor 120.

The ROM stores data and the like that are not changed during the use of the sheet postprocessing device 30, such as a control program for the sheet postprocessing device 30 and values needed for control. The RAM stores necessary data generated while the sheet postprocessing device 30 is controlled, data temporarily needed to control the sheet postprocessing device 30, and the like.

The postprocessing controller 101 can control the stapling device 67, the first folding device 70, the second folding device 90, the upstream-side driving pulley 654*a*, the downstream-side driving pulley 656*a*, the conveyance destination switching member 83, and the like. The postprocessing controller 101 controls the whole sheet postprocessing device 30.

Here, in this embodiment, when performing postprocessing on a sheet S by the sheet folding unit 60, the postprocessing controller 101 makes the blowing device 110 start to blow air when the sheet detection sensor 120 senses the first sheet S.

The postprocessing controller 101, when applying binding process on a sheet S by the stapling device 67, makes the aligning member 65 align a predetermined number of sheets S and then move them to the binding process position. Here, the postprocessing controller 101 makes the aligning member 65 move the sheets S to the binding process position and, substantially at the same time, makes the blowing device 110 stop blowing air.

The postprocessing controller 101, when applying folding process on a sheet S by the first folding device 70, makes the aligning member 65 align a predetermined number of sheets S and then move them to the folding process position. Here, the postprocessing controller 101 makes the aligning member 65 move the sheets S to the folding process position and, substantially at the same time, makes the blowing device 110 stop blowing air. When further applying folding process on the sheets S on which binding process has been applied, the postprocessing controller 101, while keeping the blowing device 110 from blowing air, has the sheets S moved from the binding process position to the folding process position.

In this embodiment, as described above, the blowing device 110 is provided which blows air between the top face of the top-most sheet S in the sheets S stacked on the sheet tray 63 and the bottom face of a sheet S sent out from the inlet guide 611 to the sheet tray 63. This permits an air layer to be formed between the bottom face of a sheet S sent from the inlet guide 611 into the sheet tray 63 (hereinafter also called a subsequent sheet S) and the top face of the top-most sheet S in the sheets which have already been stacked on the sheet tray 63 (hereinafter also called a top-most sheet S on the sheet tray 63), and thereby it is possible to prevent the subsequent sheet S from making close contact with the top-most sheet S on the sheet tray 63. This helps prevent the occurrence of a sheet jam.

As mentioned above, the blowing device 110 is arranged upstream of the inlet roller pair 612. This allows air to be easily blown between the top face of the top-most sheet S on the sheet tray 63 and the bottom face of the subsequent sheet S.

Also, as mentioned above, the pressing member 616 is provided which is arranged downstream of the inlet guide 611 and presses the upstream-side end part (trailing edge) of a sheet S which has passed the inlet roller pair 612. This helps suppress a rise (curl) at the trailing edge of a sheet S on the sheet tray 63, and thus it is possible to prevent the downstream-side end part (leading edge) of the subsequent sheet S from being caught by the trailing edge of the sheet S on the sheet tray 63. This helps prevent the occurrence of a sheet jam.

As mentioned above, the sheet tray 63 inclines downward toward the downstream side. This helps reduce the angle at which the subsequent sheet S approaches the sheet S on the sheet tray 63. That is, the subsequent sheet S can be conveyed nearly parallel to the sheet S on the sheet tray 63. This make it easier for the air to flow along the top face of the top-most sheet on the sheet tray 63 and the bottom face of the subsequent sheet, and thereby it is possible to prevent the subsequent sheet S from making close contact with the top-most sheet S on the sheet tray 63.

As mentioned above, the duct 112 discharges air substantially parallel to the sheet tray 63, and thus it is possible to pass (send) air smoothly between the top-most sheet S on the sheet tray 63 and the subsequent sheet S.

Also, as mentioned above, the postprocessing controller 101 starts the air blow by the blowing device 110 when the sheet detection sensor 120 senses the sheet S, stops the air blow by the blowing device 110 when, during binding process, making the aligning member 65 move a bundle of sheets on the sheet tray 63 to the binding process position, and stops the air blow when, during folding process, making the aligning member 65 move the sheet S on the sheet tray 63 to the folding process position. This prevents, during binding or folding process, a sheet S from being flipped by the airflow.

Also, as mentioned above, the postprocessing device main body 31 which includes the third conveying passage 44 and the blowing device 110, as well as the sheet folding unit 60 which includes the inlet guide 611, the sheet tray 63, the stapling device 67, the first folding device 70, the second folding device 90, the lower discharge port 85 and the lower discharge tray 87 and which is removable from the postprocessing device main body 31 are provided. Thus, when a sheet jam occurs in the sheet tray 63, stapling device 67, the first folding device 70, or the second folding device 90 and jam handling is performed, the sheet folding unit 60 can be drawn out with the blowing device 110 and the third conveying passage 44 left behind in the postprocessing device main body 31. That is, the sheet tray 63, stapling device 67, the first folding device 70, and the second folding device 90 can separate from the blowing device 110 and the third conveying passage 44. This facilitates jam handling.

The embodiments disclosed above should be understood to be in every aspect illustrative and not restrictive. The scope of the present disclosure is defined not by the description of the embodiments given above but by the appended claims, and should be understood to encompass any modifications made in the sense and scope equivalent to those of the claims.

For example, although the above embodiments deal with an example where the sheet folding unit 60 is provided with the first folding device 70 and the second folding device 90, this is in no way meant to limit the present disclosure. Instead, the sheet folding unit 60 may not be provided with the second folding device 90.

Also, although the above embodiments deal with an example where the pressing member 616 is provided which presses the upstream-side end part (trailing edge) of the sheet S which has passed the inlet roller pair 612, this is in no way meant to limit the present disclosure. Instead, the pressing member 616 may not be provided. In this case, for example, every time a sheet S is stacked on the sheet tray 63, the lower moving member 652 can be moved to the upstream side and, before the subsequent sheet S is conveyed, the lower moving member 652 can be retracted to the original position. In this way, moving the lower moving member 652 upstream allows the upstream-side end part (trailing edge) of the sheet S on the sheet tray 63 to be pressed by the driven roller 614 of the inlet roller pair 612 or by the guide member 615. This helps suppress a rise (curl) at the trailing edge of a sheet S on the sheet tray 63, and thus it is possible to prevent the subsequent sheet S from being caught by the trailing edge of the sheet S on the sheet tray 63.

What is claimed is:

1. A sheet postprocessing device comprising:

a sheet conveying passage for conveying a sheet on which an image has been formed;

a sheet tray which is arranged downstream of the sheet conveying passage and on which the sheet is stacked;

an inlet guide which is arranged at a downstream end of the sheet conveying passage and which guides the sheet to the sheet tray;

a processing device which performs predetermined processing on the sheet stacked on the sheet tray;

a blowing device which blows air, from an upstream side in a sheet conveying direction, between a top face of a top-most sheet in the sheets stacked on the sheet tray and a bottom face of the subsequent sheet conveyed from the inlet guide into the sheet tray;

a sheet detection sensor which is provided in the sheet conveying passage and which senses the sheet;

an aligning member which aligns a leading edge and a trailing edge of the sheets stacked on the sheet tray and which moves the sheets to a predetermined position; and a controller which controls the blowing device and the aligning member, wherein the processing device includes a stapling device which applies binding process on a plurality of the sheets stacked on the sheet tray, and a folding device which applies folding process on the sheets stacked on the sheet tray, and the controller makes the blowing device start blowing air when the sheet detection sensor senses the sheet, when applying binding process, stop blowing air while making the aligning member move a sheet bundle on the sheet tray to a binding process position, and when applying folding process, stop blowing air while making the aligning member move the sheet bundle on the sheet tray to a folding process position.

2. The sheet postprocessing device according to claim 1, further comprising:

an inlet roller pair which is arrange at an downstream end of the inlet guide and which conveys the sheet to the sheet tray, wherein the blowing device is arranged upstream of the inlet roller pair in the sheet conveying direction.

3. The sheet postprocessing device according to claim 2 further comprising a pressing member which is arranged downstream of the inlet guide in the sheet conveying direction and which presses an upstream-side end part of the sheet which has passed the inlet roller pair.

4. The sheet postprocessing device according to claim 1, wherein the sheet tray is inclined downward toward a downstream side.

5. The sheet postprocessing device according to claim 1, wherein the blowing device includes a blowing fan which generates an airflow, and a duct which discharges the airflow parallel to the sheet tray.

6. An image forming system comprising:

the sheet postprocessing device according to claim 1; and an image forming apparatus with which the sheet postprocessing device is coupled and which forms an image on a sheet and conveys the sheet to the sheet postprocessing device.

7. A sheet postprocessing device comprising:

a sheet conveying passage for conveying a sheet on which an image has been formed;

a sheet tray which is arranged downstream of the sheet conveying passage and on which the sheet stacked;

an inlet guide which is arranged at a downstream end of the sheet conveying passage and which guides the sheet to the sheet tray;

a processing device which performs predetermined processing on the sheet stacked on the sheet tray;

a blowing device which blows air, from an upstream side in a sheet conveying direction, between a top face of a top-most sheet in the sheets stacked on the sheet tray and a bottom face of the subsequent sheet conveyed from the inlet guide into the sheet tray;

a postprocessing device main body provided with the sheet conveying passage and the blowing device; and a sheet folding unit which is provided with the inlet guide, the sheet tray, the processing device, a sheet discharge port, and a discharge tray receiving the sheet discharged from the sheet discharge port and which is removable from the postprocessing device main body.

8. The sheet postprocessing device according to claim 7 further comprising:

an inlet roller pair which is arranged at a downstream end of the inlet guide and which conveys the sheet to the sheet tray, wherein the blowing device is arranged upstream of the inlet roller pair in the sheet conveying direction.

9. The sheet postprocessing device according to claim 8 further comprising a pressing member which is arranged downstream of the inlet guide in the sheet conveying direction and which presses an upstream-side end part of the sheet which has passed the inlet roller pair.

10. The sheet postprocessing device according to claim 7, wherein the sheet tray is inclined downward toward a downstream side.

11. The sheet postprocessing device according to claim 7, wherein the blowing device includes a blowing fan which generates an airflow, and a duct which discharges the airflow parallel to the sheet tray.

12. The sheet postprocessing device according to claim 7, wherein an image forming apparatus with which the sheet postprocessing device is coupled and which forms an image on a sheet and conveys the sheet on which an image has been formed to the sheet postprocessing device.

* * * * *